United States Patent [19]

Karlsson

[11] Patent Number: 4,948,930

[45] Date of Patent: Aug. 14, 1990

[54] LENGTH-ADJUSTING DEVICE ON A SWITCH

[75] Inventor: Jan Karlsson, Västra Frölunda, Sweden

[73] Assignee: AB Volvo, Sweden

[21] Appl. No.: 344,101

[22] Filed: Apr. 26, 1989

[30] Foreign Application Priority Data

Apr. 26, 1988 [SE] Sweden ..... 8801578

[51] Int. Cl.[5] ..... H01H 35/38

[52] U.S. Cl. ..... 200/82 R; 73/132; 340/454; 200/82 D

[58] Field of Search ..... 91/1; 92/5 R; 340/453, 340/454, 686; 73/39, 132, 745; 307/118; 200/34, 81 R, 82 R, 82 A, 82 D

[56] References Cited

U.S. PATENT DOCUMENTS

| | | | |
|---|---|---|---|
| 3,793,498 | 2/1974 | Matsui | 200/34 |
| 4,297,544 | 10/1981 | Priesemuth | 200/34 |
| 4,430,535 | 2/1984 | Berg et al. | 200/34 |
| 4,806,915 | 2/1989 | Rasmussen | 340/686 |

FOREIGN PATENT DOCUMENTS

| | | |
|---|---|---|
| 2926182 | 1/1981 | Fed. Rep. of Germany . |
| 958531 | 9/1949 | France . |
| 593256 | 1/1984 | Japan . |
| 61-107154 | 5/1986 | Japan . |
| 2099661 | 12/1982 | United Kingdom . |

*Primary Examiner*—Gerald P. Tolin

[57] ABSTRACT

Length-adjusting device is provided on a switch, intended to indicate the shift of an object from a normal position. The switch comprises a fixed part, intended to be assembled securely in a chassis for example, and a switch part which is movable relative to the latter and which can be changed between different positions for switching the switch depending on the position of the object. The length-adjusting device comprises a first part, which interacts with the object in its positional shifting movements, and a second part which interacts with the movable switch part such that the said second part attempts to hold the movable switch part in one of its positions. The length-adjusting device comprises at least one fluid chamber which changes volume upon relative movement between the first and the second part. A valve is connected to the chamber and permits the passage of fluid to or from the chamber and maintains a resistance to passage of fluid to or from the chamber and maintains a resistance to passage of fluid in the opposite direction. By this means the length-adjusting device adapts the position of the second part relative to the position of the first part to the distance between the normal position of the object and the switch.

2 Claims, 2 Drawing Sheets

LENGTH-ADJUSTING DEVICE ON A SWITCH

BACKGROUND OF THE INVENTION

The present invention relates to a length-adjusting device on a switch, which is intended to indicate when an object deviates from its normal position, in accordance with the preamble of Patent claim 1 below.

SUMMARY OF THE INVENTION

The aim of the present invention is to provide a length-adjusting device on a switch, in which the device adjusts its length in accordance with the conditions prevailing for each particular case of assembly.

The said aim is achieved by means of a length-adjusting device according to the invention, whose characterizing features emerge from claim 1 below.

BRIEF DESCRIPTION OF THE DRAWINGS

The invention will be described hereinafter in detail on the basis of two exemplary embodiments and with reference to the attached drawings in which FIG. 1 shows, in a first exemplary embodiment, a longitudinal section through a length-adjusting device which is integrated with the switch, while

DESCRIPTION OF THE PREFERRED EMBODIMENTS

The device described below adjusts its length in accordance with changes in the normal position $B_1$, $B_2$ of the object 2.

At the time of assembly the device described below adapts its length automatically to the normal position $B_1$ of the object 2 prevailing at the time.

When the normal position $B_1$ changes (for example, wear), the length is automatically adapted to the normal position $B_2$ prevailing after the change.

Figure 1:
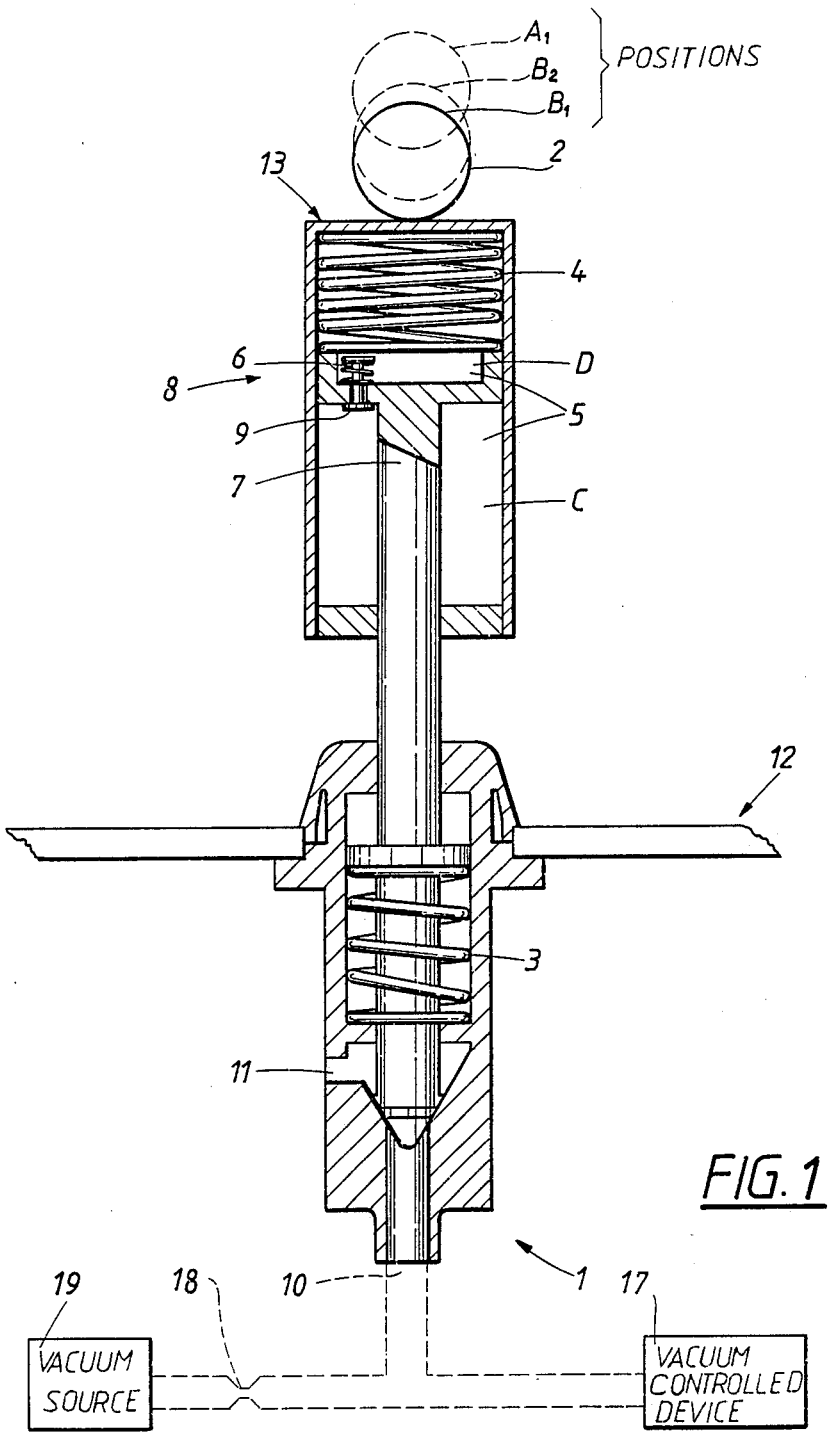

The switch 1 shown in FIG. 1 is normally open and closes, as shown in FIG. 1, when the object 2, whose position is to be indicated, is in its normal position. The spring 3 in the switch is weaker than the spring 4 in the length-adjusting device, which means that, when the object which is to be indicated moves from A→B, the switch closes. The length is then adjusted to the prevailing normal position by means of the spring 4 being compressed and a fluid 5 flowing quickly form volume D to volume C through the nonreturn valve 6. The function can also be achieved by volume D or C being connected to a external fluid. When the object whose position is to be indicated moves from position B→A, the switch 1 opens and the fluid in volume D and C maintains the piston 7 in the length-adjusting device at the adjusted position by virtue of the fact that the nonreturn valve prevents flow from C to D.

If the object which is to be indicated assumed a new normal position $B_2$ (for example, because of wear), the length of the length-adjusting device is slowly adapted by means of the spring pressing the piston down, and this is made possible by means of a fluid flowing from volume C to volume D through a calibrated restriction 9.

The leakage flow of the fluid is adapted to prevailing times on the device to be indicated and how quickly the change in the normal position of the object to be indicated is expected to occur.

The restriction 9 can, as shown in the figure, be integrated with the nonreturn valve, but it can also be positioned at a distance from the nonreturn valve. The channel 10 in the switch is connected, on the one hand, to a vacuum controlled device 17 which reacts to vacuum and, on the other hand, via a restriction 18 to a vacuum source 19. The channel 11 senses ambient pressure, i.e. atmospheric pressure.

Figure 2:
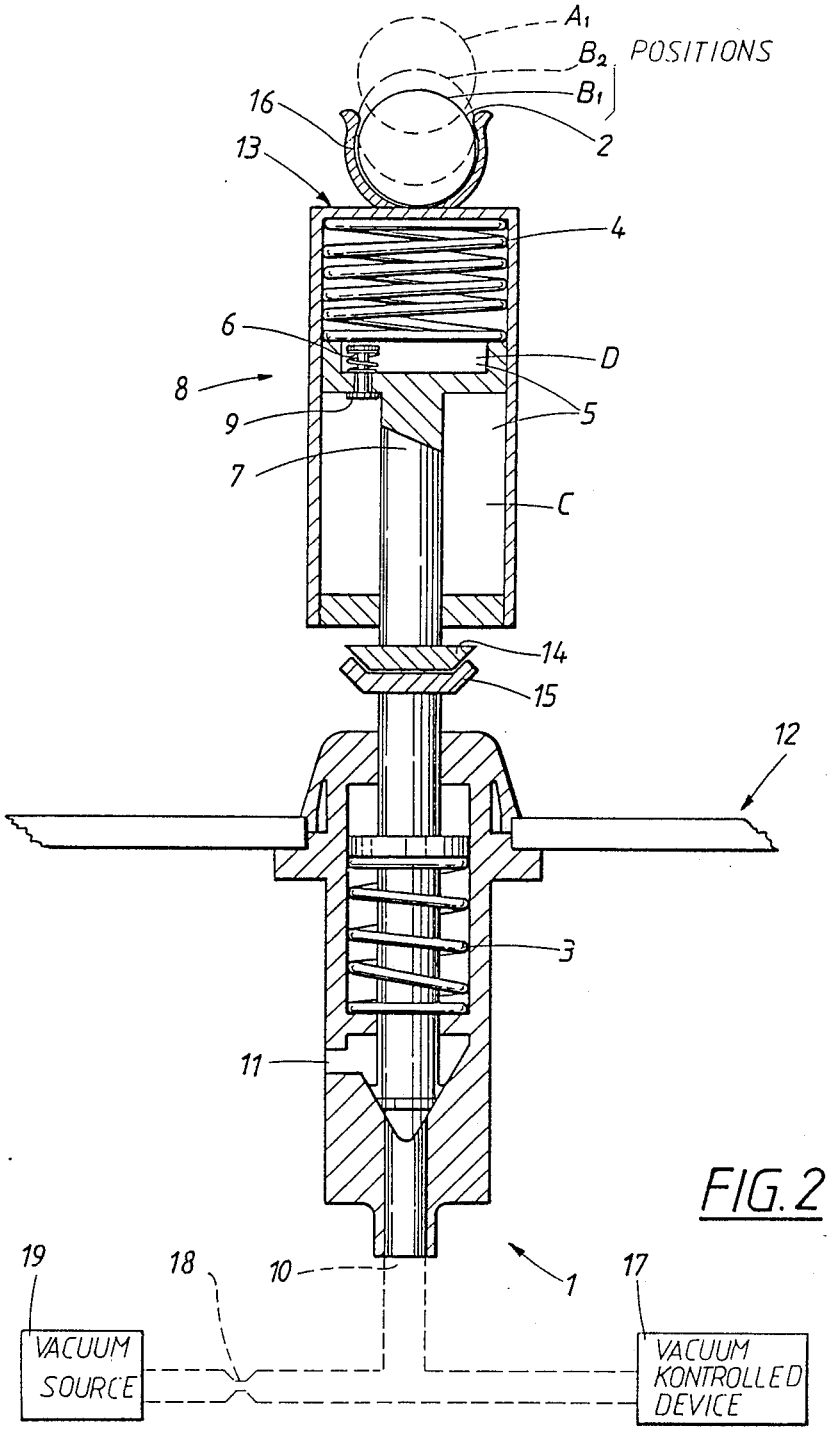
FIG. 2 shows a corresponding section through the device in a second example in which the length-adjusting device is designed as a separate unit.

FIG. 2 shows in principle the same device as in FIG. 1, but here the length-adjusting device is a separate unit. Here the common piston stem is devided. A movement-transmitting arrangement 14, 15 is fitted on each part. These are maintained bearing against each other.

The length-adjusting device 8 in this case has an element 16 for connecting to the object, for example in the form of a spring clip.

A suitable application of the self-adjusting switch described above is that of indicating when the brake pedal or clutch pedal of a vehicle deviates from its normal position.

The switch shown in the drawing indicates a change in the position of the brake pedal by means of opening a pneumatic circuit.

A need to detect the position of the brake pedal exists, for example, for controlling the brake lights, but especially in the case of a so-called constant speed fixture, which must immediately be disconnected as soon as the driver actuates the brake pedal.

A need to detect the position of the clutch pedal may occur with respect to controlling gearboxes.

The switch can be electrical, hydraulic or, as in the figure, pneumatic. In the example shown, the fluid flows between two chambers in a closed system, it being possible for the fluid to be gas, for example air, or liquid. The fluid can alternatively flow between only one chamber and the environment, in which respect the fluid is made up of air. The length-adjusting device can be inverted such that the piston part is in contact with the object, while the cylinder part is in contact with the switch. It is also conceivable for the chamber to be designed as a bellows with a flexible wall.

We claim:

1. Length-adjusting device on a switch, intended to indicate the shift of an object from a normal position, said switch comprising a fixed part, intended to be assembled securely in a chassis, and a switch part which is movable relative to the latter and which can be changed between different positions for switching the switch depending on the position of the object, said device comprising a first part, designed to interact with the object in its positional shifting movements, and a second part, designed to interact with the movable switch part such that the said second part holds the movable switch part in one of its positions, wherein the length-adjusting device comprises at least one fluid chamber designed to change volume upon relative movement between the first and the second parts, wherein a valve is connected to the chamber and is designed to permit the passage of fluid to or from the chamber and to maintain a resistance to the passage of fluid in the opposite direction, whereby length-adjusting device adapts the position of the said second part relative to the position of the said first part to the distance between the normal position of the object and the switch.

2. Length-adjusting device according to claim 1, wherein the chamber comprises a channel, designed so as to permit with resistance the passage of a leak flow in the said opposite direction, and in that the said second part of the length-adjusting device is designed to change the volume of the chamber such that the said second part follows any positional shift in the normal position of the object.

* * * * *